US008803642B2

(12) United States Patent
Imamura et al.

(10) Patent No.: US 8,803,642 B2
(45) Date of Patent: Aug. 12, 2014

(54) ELECTROMAGNETIC CONTACTOR AND ELECTROMAGNETIC CONTACTOR GAS ENCAPSULATING METHOD

(71) Applicants: Seiji Imamura, Kawasaki (JP); Kouichi Okamoto, Hino (JP); Taku Ogawa, Kounosu (JP); Yuichi Yamamoto, Kounosu (JP); Kouetsu Takaya, Kounosu (JP)

(72) Inventors: Seiji Imamura, Kawasaki (JP); Kouichi Okamoto, Hino (JP); Taku Ogawa, Kounosu (JP); Yuichi Yamamoto, Kounosu (JP); Kouetsu Takaya, Kounosu (JP)

(73) Assignees: Fuji Electric Co., Ltd., Kawasaki-shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 14/134,656

(22) Filed: Dec. 19, 2013

(65) Prior Publication Data

US 2014/0104018 A1 Apr. 17, 2014

Related U.S. Application Data

(62) Division of application No. 13/814,158, filed as application No. PCT/JP2011/006584 on Nov. 25, 2011, now abandoned.

(30) Foreign Application Priority Data

Dec. 2, 2010 (JP) ..... 2010-268952
May 19, 2011 (JP) ..... 2011-112918

(51) Int. Cl.

| | |
|---|---|
| ***H01H 9/30*** | (2006.01) |
| ***H01H 67/02*** | (2006.01) |
| ***H01H 33/60*** | (2006.01) |
| ***H01H 69/00*** | (2006.01) |
| ***H01H 1/66*** | (2006.01) |
| ***H01H 50/54*** | (2006.01) |
| ***H01H 50/60*** | (2006.01) |
| ***H01H 11/04*** | (2006.01) |
| ***H01H 49/00*** | (2006.01) |
| ***H01H 33/04*** | (2006.01) |
| ***H01H 9/34*** | (2006.01) |
| *H01H 50/02* | (2006.01) |

(52) U.S. Cl.

CPC ..... *H01H 11/04* (2013.01); *H01H 33/60* (2013.01); *H01H 2050/025* (2013.01); *H01H 50/02* (2013.01); *H01H 69/00* (2013.01); *H01H 1/66* (2013.01); *H01H 50/54* (2013.01); *H01H 50/60* (2013.01); *H01H 49/00* (2013.01); *H01H 33/04* (2013.01); *H01H 9/346* (2013.01)

USPC ..... 335/201; 335/131

(58) Field of Classification Search

CPC ... H01H 9/443; H01H 50/045; H01H 50/546; H01H 50/54; H01H 1/66

USPC ..... 335/201, 126, 131

See application file for complete search history.

(56) References Cited

U.S. PATENT DOCUMENTS

| | | | | |
|---|---|---|---|---|
| 3,786,380 | A * | 1/1974 | Harper | 335/9 |
| 4,370,634 | A * | 1/1983 | Kondo et al. | 335/16 |
| 5,051,540 | A * | 9/1991 | Schroeder | 174/549 |
| 5,126,712 | A * | 6/1992 | Sugiyama | 335/278 |
| 5,181,002 | A * | 1/1993 | Sugiyama | 335/131 |
| 5,892,194 | A * | 4/1999 | Uotome et al. | 218/68 |
| 6,768,405 | B2 * | 7/2004 | Nishida et al. | 335/177 |
| 6,975,194 | B2 * | 12/2005 | Nishida et al. | 335/132 |
| 7,023,306 | B2 * | 4/2006 | Nishida et al. | 335/132 |
| 7,034,241 | B2 * | 4/2006 | Fleege et al. | 218/157 |
| 7,859,373 | B2 * | 12/2010 | Yamamoto et al. | 335/126 |
| 8,138,863 | B2 * | 3/2012 | Tanaka et al. | 335/195 |
| 8,138,872 | B2 * | 3/2012 | Yoshihara et al. | 335/281 |
| 8,179,217 | B2 * | 5/2012 | Kawaguchi et al. | 335/80 |
| 2004/0080389 | A1 * | 4/2004 | Nishida et al. | 335/132 |
| 2005/0151606 | A1 * | 7/2005 | Nishida et al. | 335/128 |
| 2007/0241847 | A1 * | 10/2007 | Yamamoto et al. | 335/196 |
| 2009/0096559 | A1 * | 4/2009 | Yano et al. | 335/187 |

| | | | | |
|---|---|---|---|---|
| 2009/0237191 | A1* | 9/2009 | Yano et al. | 335/202 |
| 2009/0322455 | A1* | 12/2009 | Yoshihara et al. | 335/189 |
| 2010/0225427 | A1* | 9/2010 | Fujimoto et al. | 335/2 |

* cited by examiner

*Primary Examiner* — Alexander Talpalatski
(74) *Attorney, Agent, or Firm* — Manabu Kanesaka

(57) ABSTRACT

An electromagnetic contactor has a base plate having an aperture hole; an arc extinguishing chamber including a fixed terminal having a vent portion and a pipe obliquely inserted from outside a wall surface and connecting the vent portion; and a bottomed tubular cap in which one end thereof is open. An arc extinguishing chamber connection portion is formed by the arc extinguishing chamber and a first connection member having a tube portion connected to the arc extinguishing chamber and a flange portion contacting with the base plate. A cap connection portion is formed by the cap and a second connection member having a tube portion connected to the cap and a flange portion connected to the base plate. The arc extinguishing chamber connection portion and the cap connection portion are in communication through the aperture hole of the base plate.

3 Claims, 8 Drawing Sheets

ELECTROMAGNETIC CONTACTOR AND ELECTROMAGNETIC CONTACTOR GAS ENCAPSULATING METHOD

CROSS-REFERENCE TO RELATED APPLICATIONS

The present application is a divisional application of U.S. Ser. No. 13/814,158, filed on Mar. 11, 2013, which is a National Stage of PCT/JP2011/006584, filed on Nov. 25, 2011, which claims priorities of Japanese patent application number 2010-268952, filed on Dec. 2, 2010 and Japanese patent application number 2011-112918, filed on May 19, 2011, which is incorporated by reference in its entirety.

TECHNICAL FIELD

The present invention relates to an electromagnetic contactor including a contact device that includes a fixed contact and movable contact interposed in a current path, and in particular, relates to the electromagnetic contactor and a gas encapsulating method whereby gas is encapsulated inside the electromagnetic contactor.

BACKGROUND ART

A heretofore known gas encapsulating structure (hereafter called a capsule structure) of an electromagnetic contactor is the kind of structure shown in FIG. 5 wherein, specifically, a fixed contact 26, a movable terminal 27 having a movable contact 27*a*, a movable shaft 28, a contact spring 29, and the like, are incorporated inside an arc extinguishing chamber 1. Also, a movable iron core 30 and return spring 31 to which the movable shaft 28 is linked are incorporated inside a cap 8. No description will be given of details at this point.

Firstly, the arc extinguishing chamber 1 and a fixed terminal 2, and The arc extinguishing chamber 1 and a first connection member 4, are joined by brazing, and the cap 8 and a second connection member 5 are joined by welding (laser welding or micro TIG welding). Then, a base plate 7 and the first connection member 4 are joined by seal welding, and the base plate 7 and second connection member 5 are also joined by seal welding. The seal welding is such that joining is carried out by resistance welding (projection welding) or laser welding.

A gas encapsulating type projection welding is such that, as shown in FIG. 6, an upper electrode portion 15 and lower electrode portion 16 inside a gas encapsulation chamber 14 are installed inside the gas encapsulation chamber 14, and it necessary constantly causes a gas 19 to flow in order to maintain a gas atmosphere 18. Because of this, there is a problem in that the gas encapsulation chamber 14 is also unavoidably of a large size. In particular, when inserting a plurality of capsule structure portions 13 in order to carry out seal welding, evacuating and charging of the gas encapsulation chamber 14 are repeated when replacing with the next capsule structure portions 13 on finishing the seal welding. Because of this, there is a problem in that a considerable time is needed for the evacuating and charging of the gas encapsulation chamber. With this kind of step, there is a problem in that the amount of encapsulated gas consumed also increases.

With a gas encapsulating type laser welding, there is a method whereby a plurality of workpieces 24 to and from which hydrogen gas 20 is supplied and evacuated is inserted into a chamber 21 to and from which the hydrogen gas 20 can be supplied and evacuated, and the workpiece 24 is laser welded by a laser beam 25 being caused to fall incident thereon from the exterior of the chamber 21 through a transparent glass window 22, as shown in FIG. 7. With this method, however, a C-shaped supply and evacuation hole 23 is provided in one portion of the workpiece 2, and it is necessary to laser weld the supply and evacuation hole 23. It is necessary to process the C-shaped supply and evacuation hole 23 in advance with high accuracy in one portion of a sealed part, and to set laser irradiation conditions, and weld, in such a way as not to distort the C-shaped supply and evacuation hole 23. Because of this, it cannot be said that the gas encapsulating type of laser welding is a technologically easy manufacturing method. Also, as laser welding is carried out through the transparent glass window 22 of the chamber 21, a large amount of spatter, fumes, and the like, are generated when welding, meaning that there is a problem in that the transparent glass window 22 becomes dirty, and the inside of the chamber 21 becomes dirty easily.

A method whereby a laser welding head is inserted into the chamber 21 and welding carried out has also been disclosed as a method other than laser welding through the transparent glass window 22 of the chamber 21 (for example, refer to PLT 1). With this method, however, there is also a problem in that the size of the chamber increases.

With the heretofore described kinds of gas encapsulating type projection welding method and laser welding method, seal welding is possible provided that the gas encapsulation pressure inside the capsule structure portion is a pressure in the region of atmospheric pressure or slightly higher than atmospheric pressure. However, when the gas encapsulation pressure becomes a gas pressure of a few atmospheres or more higher again, it becomes difficult to carry out seal welding with good mass productivity, while maintaining the gas encapsulation pressure, in the gas encapsulation chamber of the heretofore described kind of gas encapsulating type projection welding method and the chamber of the laser welding method.

Meanwhile, as a method other than the heretofore described welding methods, there is the method shown in FIG. 8. That is, the base plate 7 and pipe 3 are joined in advance by brazing or soldering. Subsequently, the base plate 7 and first connection member 4, and the base plate 7 and second connection member 5, are seal welded by laser welding or projection welding. It should be noted that it is not necessary at this stage to weld while encapsulating gas. Then, in the final stage, gas is encapsulated via the pipe 3, and the pipe 3 is hermetically sealed by being crushed and pressure welded by a pressure tool under a predetermined gas pressure, or hermetically sealed with a handheld ultrasonic welder or the like.

With this kind of method, enclosure and encapsulation are possible with a gas pressure when encapsulating gas of atmospheric pressure or a pressure higher than atmospheric pressure. In this case, however, it is necessary for the pipe 3 to be joined in advance to the base plate 7, and as a method of doing this, a plating processing and hole processing with respect to the base plate 7, and a brazing or soldering of the base plate 7 and pipe 3, are necessary. In particular, as brazing or soldering is a separate step requiring air tightness, unnecessary time is taken. Furthermore, in the case of soldering, the heating temperature is low, meaning that no thermal deformation of the base plate 7 is caused, but there is depreciation in long-term reliability in terms of the strength of the soldered portion. Meanwhile, with brazing, as the brazing temperature becomes high, thermal deformation of the base plate 7 is caused.

Herein, as kinds of gas used in encapsulation, there are hydrogen gas, nitrogen gas, a mixed gas of hydrogen and nitrogen, air, or the like.

CITATION LIST

Patent Literature

PLT 1: Japanese Patent No. 3,835,026
PLT 2: JP-A-4-182092

SUMMARY OF INVENTION

Technical Problem

Therefore, the invention, considering the various heretofore described problems, has an object of simplifying a heretofore known gas encapsulating step of a capsule structure portion, thereby providing an electromagnetic contactor, electromagnetic contactor gas encapsulating method, and electromagnetic contactor manufacturing method at a low cost and with stable quality.

Solution to Problem

In order to achieve the heretofore described object, a first aspect of an electromagnetic contactor according to the invention includes a base plate having an aperture hole, a tub-like arc extinguishing chamber in which one end thereof is open, and having a fixed terminal and pipe penetrating and fixed to a wall surface, and a bottomed tubular cap in which one end thereof is open. Further, in the electromagnetic contactor, an arc extinguishing chamber connection portion is formed by the arc extinguishing chamber and a first connection member having a tube portion in which one end thereof closely contacts with and is connected to the open end surface of the arc extinguishing chamber and a flange portion linked to the other end of the tube portion that close contacts with the base plate. Also, in the electromagnetic contactor, a cap connection portion is formed by the cap and a second connection member having a tube portion in which one end thereof closely contacts with and is connected to the open end surface of the cap and a flange portion linked to the other end of the tube portion that closely contacts the base plate. Furthermore, the electromagnetic contactor is configured in such a way that the flange portion of the first connection member of the arc extinguishing chamber connection portion is attached to one surface of the base plate and the flange portion of the second connection member of the cap connection portion is attached to the other surface of the base plate so that the arc extinguishing chamber connection portion and the cap connection portion communicate through the aperture hole of the base plate.

Also, a second aspect of the electromagnetic contactor according to the invention includes a base plate having an aperture hole, a tub-like arc extinguishing chamber in which one end thereof is open, having a fixed terminal penetrating through and fixed to a wall surface and a pipe inserted from outside the wall surface into a vent linking a portion communicating between a portion outside the wall surface of the fixed terminal and a portion inside the wall surface of the fixed terminal, and a bottomed tubular cap in which one end thereof is open. In the electromagnetic contactor, an arc extinguishing chamber connection portion is formed by the arc extinguishing chamber and a first connection member having a tube portion in which one end thereof closely contacts with and is connected to the open end surface of the arc extinguishing chamber and a flange portion linked to the other end of the tube portion that closely contacts with the base plate. Also, in the electromagnetic contactor, a cap connection portion is formed by the cap and a second connection member having a tube portion in which one end thereof closely contacts with and is connected to the open end surface of the cap and a flange portion linked to the other end of the tube portion that close contacts with the base plate. Furthermore, the electromagnetic contactor is configured in such a way that the flange portion of the first connection member of the arc extinguishing chamber connection portion is attached to one surface of the base plate and the flange portion of the second connection member of the cap connection portion is attached to the other surface of the base plate so that the arc extinguishing chamber connection portion and the cap connection portion are in communication via the aperture hole of the base plate.

Also, the electromagnetic contactor according to a third aspect of the invention includes a base plate having an aperture hole, a tub-like arc extinguishing chamber configured of a fixed terminal support insulating substrate, through which a fixed terminal and pipe penetrate and are fixed, and a cylinder portion in which one end thereof closely contacts with, and is connected to, an outer peripheral edge portion of one surface of the fixed terminal support insulating substrate, and a bottomed tubular cap in which one end thereof is open. An arc extinguishing chamber connection portion is formed by the arc extinguishing chamber and a third connection member having a flange portion, formed integrally with the cylinder portion of the arc extinguishing chamber, that close contacts with the base plate. A cap connection portion is formed by the cap and a second connection member having a tube portion in which one end thereof closely contacts with and is connected to the open end surface of the cap and a flange portion, linked to the other end of the tube portion, that closely contacts with the base plate. The flange portion of the third connection member in the arc extinguishing chamber connection portion is attached to one surface of the base plate, and the flange portion of the second connection member in the cap connection portion is attached to the other surface of the base plate so that the arc extinguishing chamber connection portion and the cap connection portion are in communication via the aperture hole of the base plate.

Also, a fourth aspect of the electromagnetic contactor according to the invention is such that, in any one of the first to third aspects, gas is introduced through the pipe into the arc extinguishing chamber and cap, and when the pressure of the introduced gas reaches a predetermined pressure, an aperture portion of the pipe is closed off, which creates a state wherein the gas is sealed.

Also, a first aspect of an electromagnetic contactor gas encapsulating method according to the invention is a gas encapsulating method of the electromagnetic contactor of any one of the first to third aspects, whereby gas is introduced from the pipe, and an aperture portion of the pipe is closed off when the pressure of the introduced gas reaches a predetermined gas pressure, forming a gas encapsulating sealed vessel wherein gas is sealed in the arc extinguishing chamber and the cap.

Also, a first aspect of an electromagnetic contactor manufacturing method according to the invention includes a step of forming an arc extinguishing chamber connection portion by simultaneously brazing a fixed terminal and a pipe penetrating, which are fixed to an arc extinguishing chamber, and a tube portion of a first connection member in communication with an open end portion of the arc extinguishing chamber, and a step of forming a cap connection portion having a flange portion extending outwardly in a radial direction at an open end of a bottomed tubular cap. Furthermore, the first aspect of the electromagnetic contactor manufacturing method includes a step of disposing a flange portion of the first connection member and a flange portion of a second connection member in close contact with a base plate in which an aperture hole is formed, and welding each flange portion to the base plate so that the arc extinguishing chamber connection portion and the cap connection portion are in communication via the aperture hole.

Also, a second aspect of the electromagnetic contactor manufacturing method according to the invention includes a step of simultaneously forming an arc extinguishing chamber and an arc extinguishing chamber connection portion by simultaneously brazing a fixed terminal and pipe penetrating through and fixed to a fixed terminal support insulating substrate and a cylinder portion in which one end thereof is linked to an outer peripheral edge portion of the fixed terminal support insulating substrate, with the other end of which a third connection member is integrally formed, and a step of forming a cap connection portion having a flange portion extending outwardly in a radial direction at an open end of a bottomed tubular cap. Furthermore, the second aspect of the electromagnetic contactor manufacturing method includes a step of disposing a flange portion of the third connection member and a flange portion of a second connection member in close contact with a base plate in which an aperture hole is formed, and welding each of the flange portions to the base plate so that the arc extinguishing chamber connection portion and the cap connection portion are in communication via the aperture hole.

Advantageous Effects of Invention

According to one aspect of the invention, a device or gas encapsulation chamber for encapsulating and evacuating gas, such as with the gas encapsulating type projection welding method, becomes unnecessary, and it is possible to contribute to a reduction in equipment cost and gas consumption by eliminating accompanying equipment, as well as a reduction in time for encapsulating and evacuating gas, and the like, is possible, meaning that the production rate greatly improves. Also, in the case of gas encapsulating type laser welding, laser welding inside a supply and evacuation chamber becomes unnecessary, and the kind of laser welding in which technological precision is also required, such as the C-shaped supply and evacuation hole, also becomes unnecessary. In other words, it is possible to obtain the same kind of advantage as with the gas encapsulating type projection welding. Furthermore, with regard to spatter, fumes, and the like generated when laser welding, welding is carried out in the air, meaning that a normally used evacuation device is sufficient, and cleaning and maintenance inside the chamber also become unnecessary.

Also, with regard to the encapsulation of a high pressure gas inside the capsule structure, as with the gas encapsulating types of projection welding method and laser welding method, the gas encapsulation method of the invention has no problem of a reduction in mass productivity and as far as maintaining gas pressure is concerned, pressure can be set and regulated as desired, meaning that a considerable improvement in productivity is possible.

Meanwhile, with regard to the heretofore known method of installing the pipe in the base plate described in the background art, two brazing steps are necessary—brazing the ceramic arc extinguishing chamber and the base plate having a protruding portion, and brazing (or soldering) the base plate and the pipe. With the manufacturing method of the invention, however, it is possible for all brazing steps to be carried out only on the arc extinguishing chamber side, and thus possible to reduce the assembling steps for the manufacturing process. That is, as the pipe brazing step can be carried out in a furnace together with the brazing of the fixed terminal and connection member, it is possible to simplify the work.

DESCRIPTION OF EMBODIMENTS

Hereafter, a description will be given of embodiments of the invention, based on FIG. 1 to FIG. 4.

Figure 1:
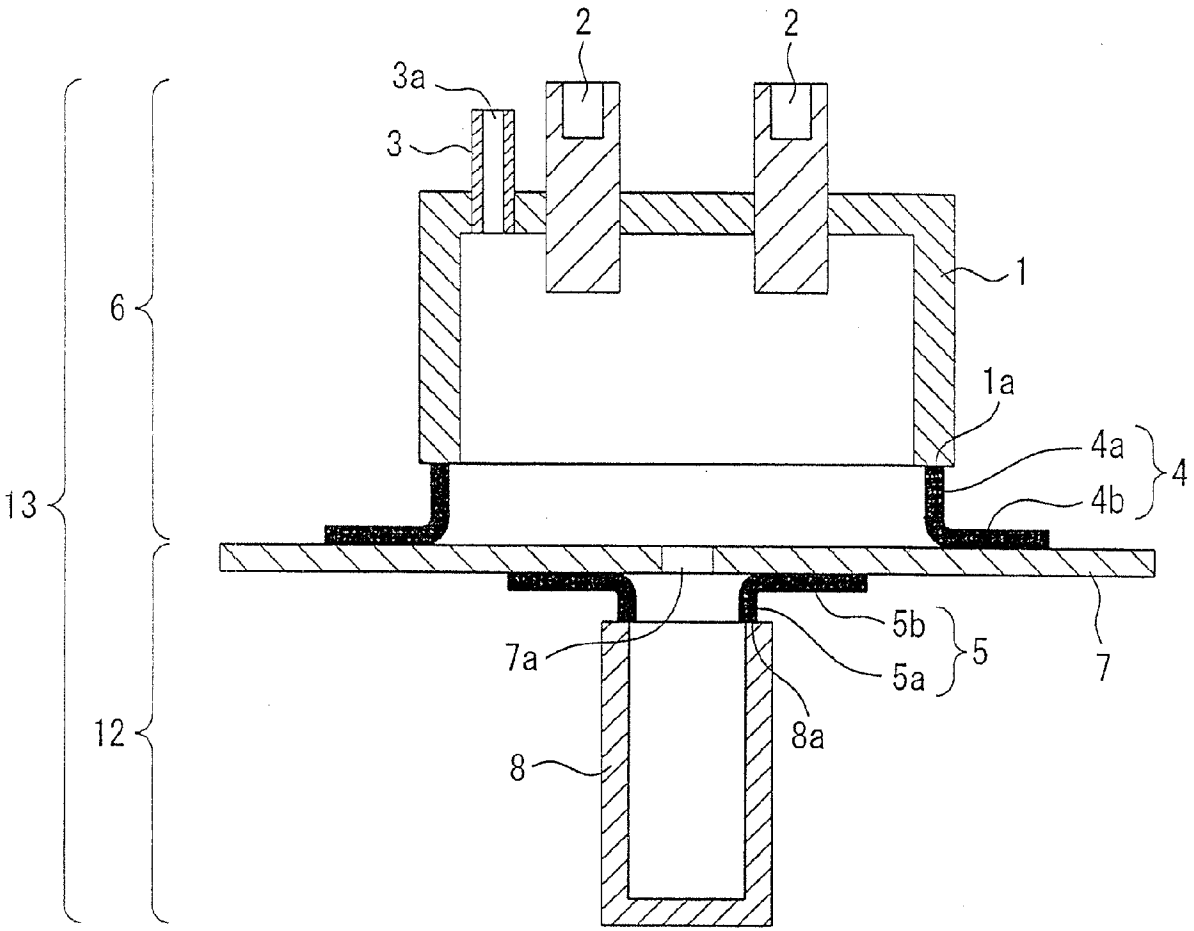
FIG. 1 is a front sectional view showing a first embodiment of an electromagnetic contactor according to the invention.
Figure 2:
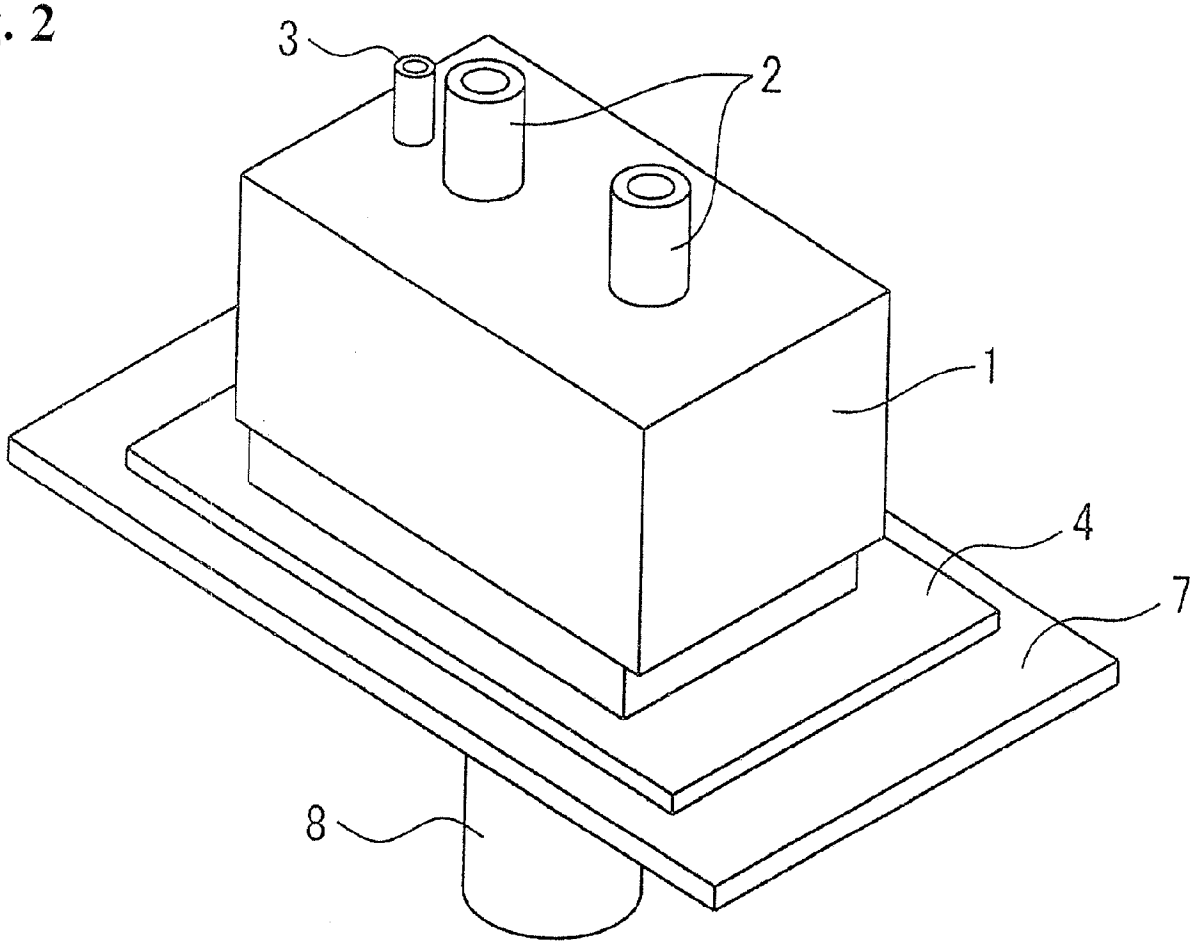
FIG. 2 is a perspective view of the electromagnetic contactor showing the first embodiment of the invention.

FIG. 1 is a sectional view of a capsule structure showing a first embodiment of an electromagnetic contactor according to the invention. FIG. 2 is a perspective view of the exterior of the capsule structure of the electromagnetic contactor shown in FIG. 1, while FIGS. 3(*a*) and 3(*b*) are sectional views of capsule structures of electromagnetic contactors showing modification examples of the first embodiment of the invention. FIG. 4 is a sectional view of a capsule structure showing a second embodiment of an electromagnetic contactor according to the invention.

That is, in the working example shown in FIG. 1, a pair of fixed terminals 2 made of, for example, copper is joined by brazing to a tub-like arc extinguishing chamber 1, whose lower end surface is open and integrally formed by, for example, firing a ceramic. The fixed terminals 2 penetrate the upper side wall surface of the arc extinguishing chamber 1 while maintaining a predetermined interval. Furthermore, in the same way, a hollow pipe 3 made of, for example, copper is joined by brazing to the upper side wall surface of the arc extinguishing chamber 1, penetrating the upper side wall surface.

By a tube portion 4*a*, formed in an elongated protruding form, of a first connection member 4 being joined by brazing to an aperture end portion 1*a* of the arc extinguishing chamber 1 to which the fixed terminals 2 and pipe 3 are brazed, an arc extinguishing chamber connection portion 6 is assembled. The joining of the fixed terminals 2, pipe 3, and tube portion 4*a* of the first connection member 4 to the arc extinguishing chamber 1 can be integrated by brazing simultaneously in a furnace.

At this time, a metalizing process is carried out on the arc extinguishing chamber 1, forming a metal layer or metal film in the positions to which the fixed terminals 2, pipe 3, and tube portion 4*a* of the first connection member 4 are to be brazed, and nickel plating is formed on the metal layer or metal film.

Also, as the first connection member 4 is of a ferrous material, it is preferable that brazability is ensured by performing, for example, an electro nickel plating, or the like. Also, it goes without saying that consideration is given to the difference between the expansion coefficient of the ceramic material configuring the arc extinguishing chamber 1 and the expansion coefficient of the copper fixed terminals 2 and pipe 3, and forms such that no stress or strain occurs are adopted.

Further, the assembled arc extinguishing chamber connection portion 6 is such that a flange portion 4*b* integrally linked to the tube portion 4*a* of the first connection member 4 close contacts a base plate 7, which are joined by seal welding.

Also, in a bottomed tubular cap 8 in which one end thereof is sealed, a cap connection portion 12 is assembled by a tube portion 5*a*, which forms an elongated protrusion, of a second connection member 5, being joined by seal welding to an aperture end portion 8*a* of the cap 8. In order to attach the cap connection portion 12 to the base plate 7, a flange portion 5*b* provided in the second connection member 5 close contacts the base plate 7, which are seal welded.

At this time, the arc extinguishing chamber connection portion 6 and cap connection portion 12 are attached so as to be in communication with each other via an aperture hole 7*a* provided in the base plate 7. By so doing, a capsule structure portion 13 of the electromagnetic contactor is assembled.

The method of joining the arc extinguishing chamber 1, fixed terminals 2, pipe 3, and first connection member 4 of the arc extinguishing chamber connection portion 6 is such that simultaneous joining can be carried out using vacuum brazing.

Herein, it is preferable that the first and second connection members 4 and 5 are formed using a material with a low expansion rate, the base plate 7 is formed using a magnetic material, and the cap 8 is formed using a non-magnetic material.

In actual practice, when assembling the capsule structure portion 13, a movable terminal 27, in which a movable contact 27*a* is disposed, disposed inside the arc extinguishing chamber 1, a movable shaft 28 that supports the movable terminal 27, and a contact spring 29, disposed around the movable shaft 28, that presses the movable contact 27*a* against a fixed contact 26, are disposed on one surface of the base plate 7, as illustrated in FIG. 4. Also, a movable iron core 30 and return spring 31 linked to the movable shaft 28, which is extended penetrating the aperture hole 7*a*, are disposed on the other surface of the base plate V. Further, the arc extinguishing chamber connection portion 6 is disposed on the base plate 7 so as to cover the movable terminal 27, movable shaft 28, and contact spring 29, and the cap connection portion 12 is disposed on the base plate 7 so as to cover the movable shaft 28, movable iron core 30, and return spring 31, and the arc extinguishing chamber connection portion 6 and cap connection portion 12 are seal welded to the base plate 7.

Then, on the capsule structure portion 13 of the electromagnetic contactor being assembled, firstly, a gas evacuation device is connected to the pipe 3 and the gas inside the capsule structure portion 13 evacuated, after which, a gas supply source (not shown) is connected to the pipe 3, and pressurized gas is introduced from the gas supply source into the arc extinguishing chamber 1 via the pipe 3. Then, when the pressure of the introduced gas reaches a predetermined pressure, an aperture portion 3*a* of the pipe 3 is closed off with a sealing tool. Because of this, it is possible to encapsulate a gas of a predetermined internal pressure inside the arc extinguishing chamber 1 and cap 8.

In this way, steps of evacuating gas, introducing gas, and encapsulating with gas pressure maintained are necessary for a gas encapsulating method, but this series of working steps can be carried out by attaching and removing a one-touch operation type pipe to which both the gas evacuation device and gas supply source are connected to and from the pipe 3, and it is thus possible to achieve an increase in cycle time speed.

Herein, as kinds of gas supplied from the gas supply source, there are hydrogen gas, nitrogen gas, a mixed gas of hydrogen and nitrogen, air, or the like.

This gas encapsulating method is such that, as the gas is encapsulated from the pipe 3, it is free in selecting the gas pressure, and the pressure is easily regulated. Also, as the encapsulating method, it is possible to close off the aperture portion 3*a* of the pipe 3 in an extremely short time, so that the production rate increases. Of course, a handheld ultrasonic welder also is possible as a method of sealing the pipe 3, and the encapsulating method is not limited.

In this way, according to the first embodiment, it is possible to simultaneously braze the fixed terminals 2, pipe 3, and first connection member 4 to the arc extinguishing chamber 1. Because of this, it is possible for the connection of the fixed terminals 2 and pipe to the arc extinguishing chamber 1 and the formation of the arc extinguishing chamber connection portion 6 to be carried out simultaneously, and thus possible to simplify the step of forming the arc extinguishing chamber 1 and arc extinguishing chamber connection portion 6. Also, the encapsulating of gas in the arc extinguishing chamber 1 and cap 8 can also be carried out easily.

Figure 3A:
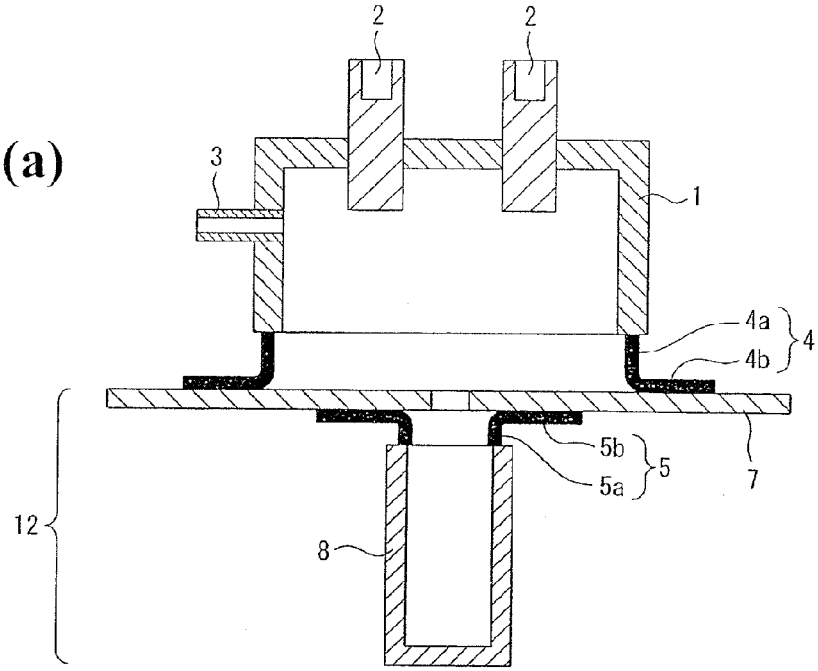
FIGS. 3(*a*) and 3(*b*) are front sectional views of electromagnetic contactors showing modification examples of the first embodiment of the invention, wherein FIG. 3(*a*) shows a first modification example and FIG. 3(*b*) a second modification example.
Figure 3B:
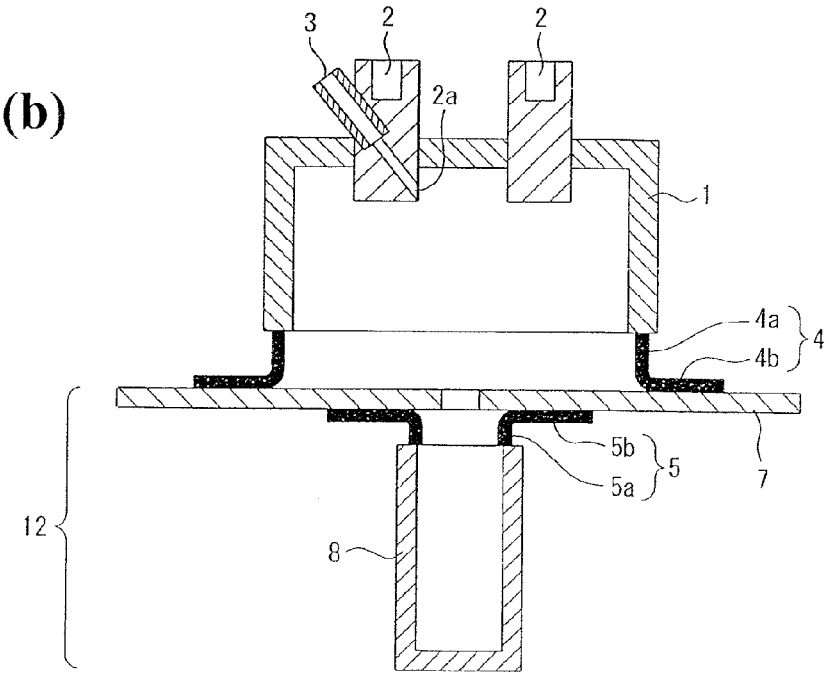
Figure 4:
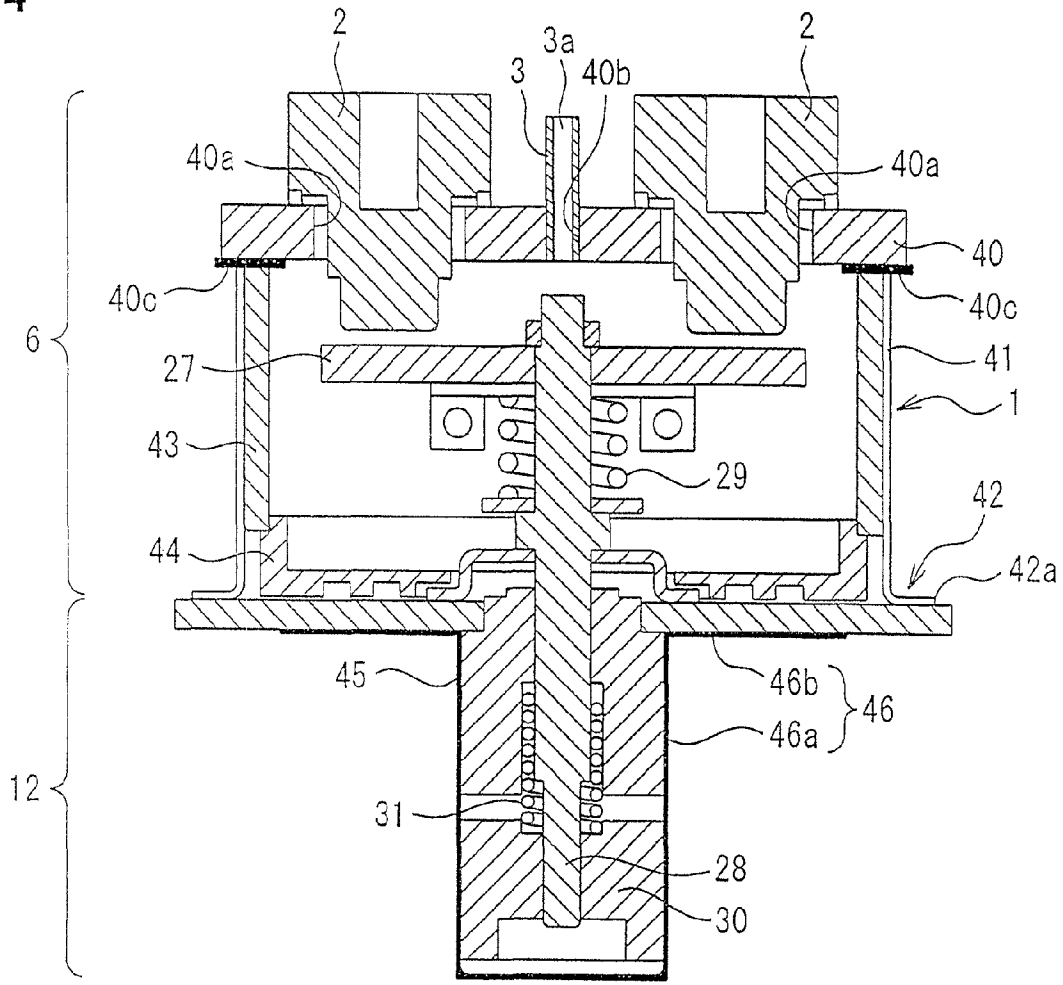
FIG. 4 is a front sectional view showing a second embodiment of an electromagnetic contactor according to the invention.
Figure 5:
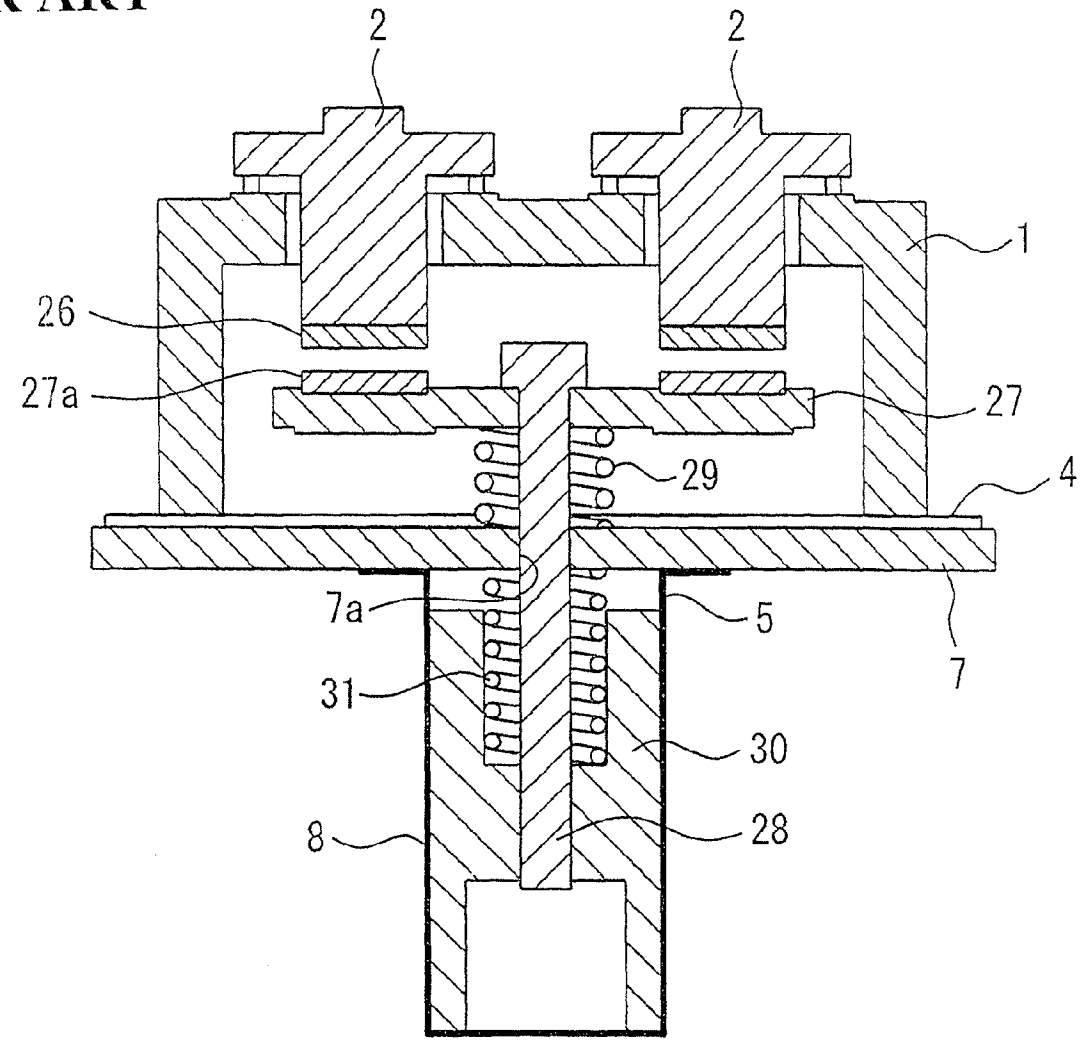
Fig. 5 PRIOR ART
FIG. 5 is a front sectional view showing a heretofore known electromagnetic contactor.
Figure 6:
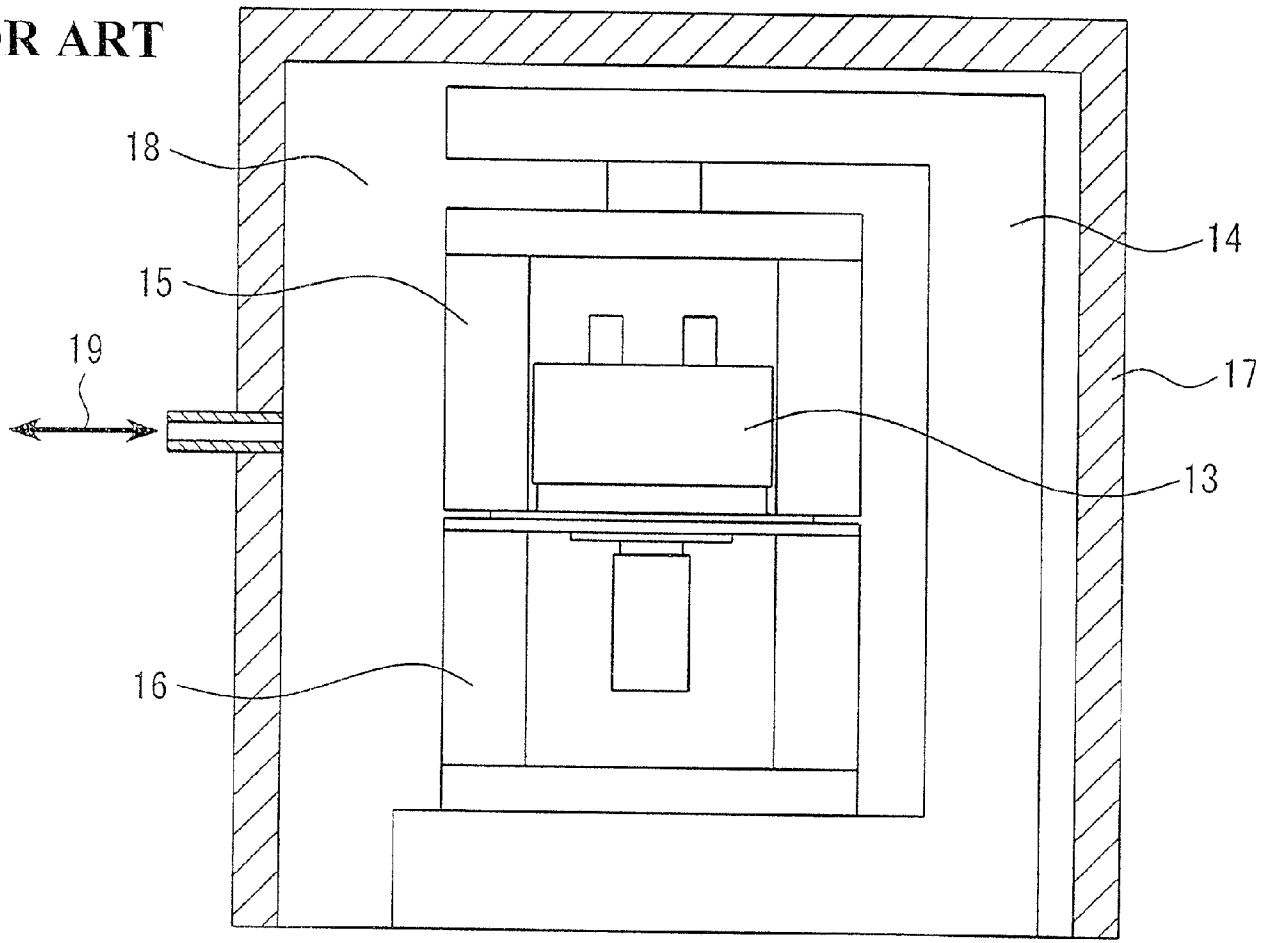
Fig. 6 PRIOR ART
FIG. 6 is a schematic view showing a heretofore known gas encapsulating type projection welding.
Figure 7:
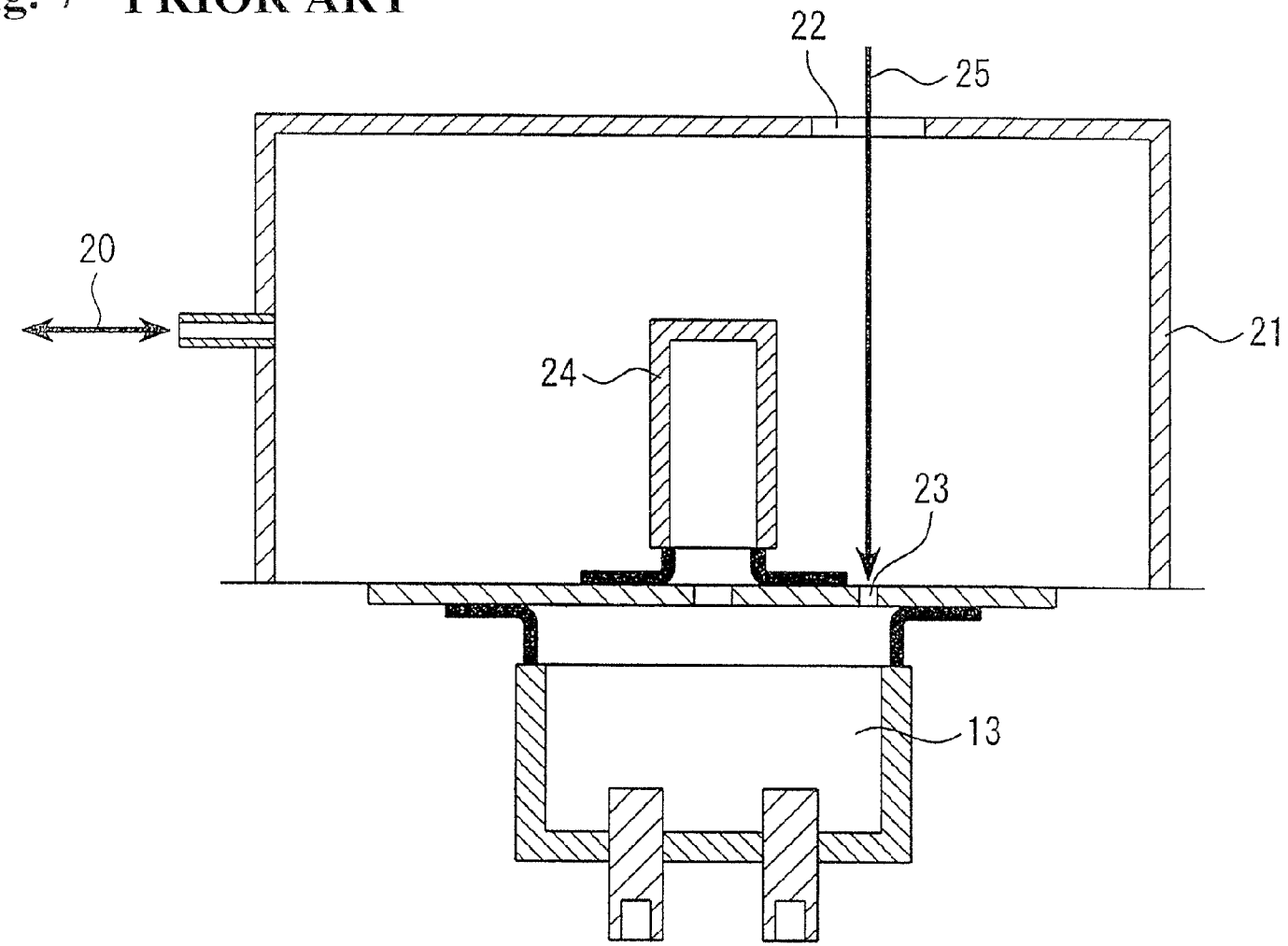
Fig. 7 PRIOR ART
FIG. 7 is a schematic view showing a heretofore known gas encapsulating type laser welding.
Figure 8:
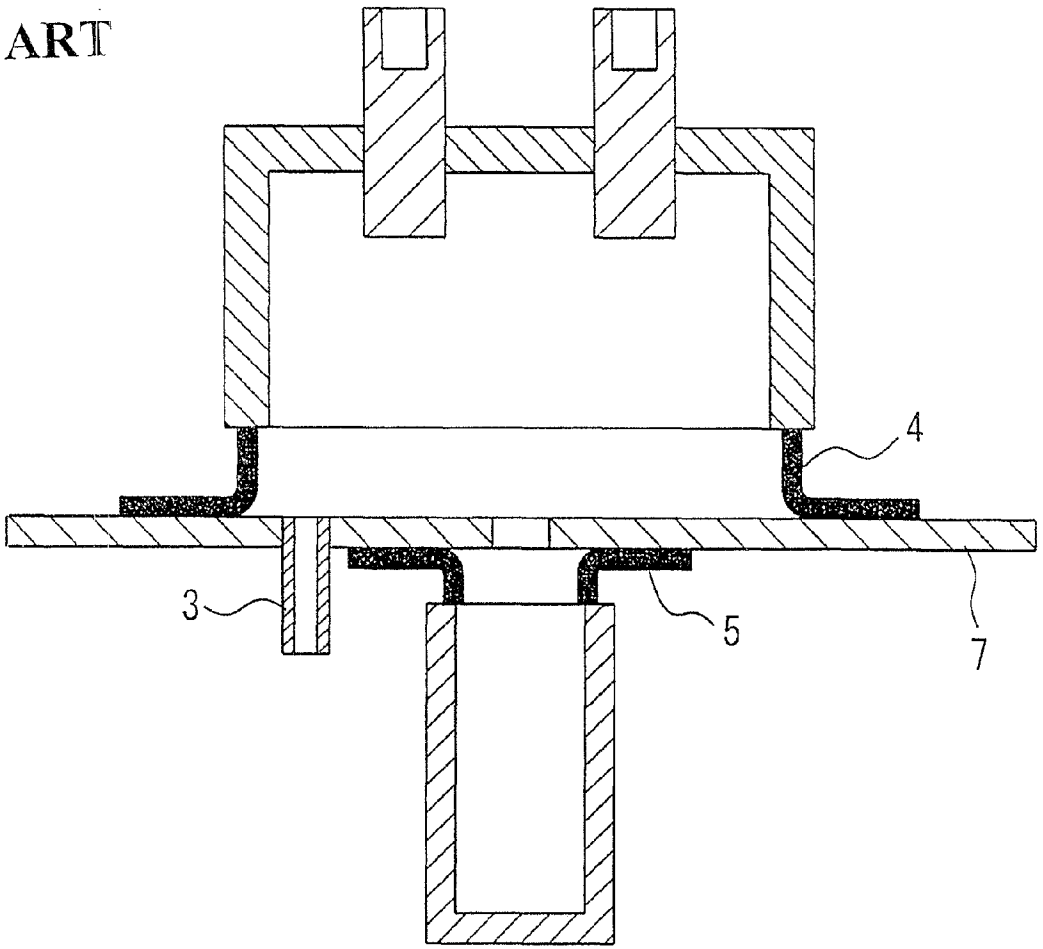
Fig. 8 PRIOR ART
FIG. 8 is a heretofore known front sectional view showing a method other than the welding methods shown in FIG. 5 and FIG. 6.

In the first embodiment, a description has been given of a case wherein the pipe 3 is fixed penetrating the upper side wall of the arc extinguishing chamber 1 but, not being limited to this, the pipe 3 may be joined penetrating a wall surface in a direction perpendicular to the fixed terminals 2 fixed to the arc extinguishing chamber 1, as shown in FIG. 3(*a*). When joining the pipe 3 to a side wall of the arc extinguishing chamber 1 in this way, there is an advantage in that there is a degree of freedom in the installation space of the pipe 3.

Also, in the first embodiment, a description has been given of a case wherein the fixed terminals 2 and pipe 3 are individually disposed penetrating the arc extinguishing chamber 1 but, not being limited to this, it is also possible to configure in the way shown in FIG. 3(*b*). That is, in this working example, a stepped vent 2*a* is formed in one fixed terminal of the pair of fixed terminals 2, obliquely penetrating a region on the outer side of the side wall of the arc extinguishing chamber 1 and a region on the inner side of the side wall distanced from a portion in contact with the movable contact, and the pipe 3 is joined to the portion of the vent 2*a* with the larger diameter.

In this case, the processing of a hole for the pipe 3 in the arc extinguishing chamber 1 becomes unnecessary, and whether the processing of holes in the arc extinguishing chamber 1 is implemented at a stage before the firing of the ceramic, or whether the holes are processed after the firing of the ceramic, the reduction in the number of processing of the arc extinguishing chamber 1 is effective in terms of time and steps. Furthermore, as the pipe 3 and fixed terminal 2 are of the same material, joining the pipe 3 to the vent 2*a* provided in the fixed terminal 2 also has the advantage of being brazed easily.

Also, in the first embodiment, a description has been given of a case wherein the cap 8 and second connection member 5 are configured of separate bodies but, not being limited to this, the cap 8 and second connection member 5 may be formed integrally by forming a flange portion protruding outward in a radial direction on an open end portion of the cap 8.

Next, a description will be given of a second embodiment of the invention, based on FIG. 4.

The second embodiment is such that, instead of the case wherein the tub-like arc extinguishing chamber is formed integrally, the arc extinguishing chamber is formed of a terminal support insulating substrate and a third connection member.

That is, in the second embodiment, a fixed terminal support insulating substrate 40 is included. Through holes 40*a* that fix the pair of fixed terminals 2 and a through hole 40*b* that fixes the pipe 3 are formed in the fixed terminal support insulating substrate 40. Also, the fixed terminal support insulating substrate 40 is configured as a ceramic insulating substrate by a metalizing process being carried out with a metal such as copper foil on a plate-like ceramic base in which the through holes 40*a* and 40*b* are formed, around the through holes 40*a* and 40*b* and on an outer peripheral edge portion 40*c* of one surface.

Further, the fixed terminals 2 are inserted into the through holes 40*a* of the fixed terminal support insulating substrate 40 and brazed, while the pipe 3 is inserted into the through hole 40*b* and brazed.

Furthermore, a tubular cylinder portion 41 made of metal is brazed to the outer peripheral edge portion 40*c* on the lower surface of the fixed terminal support insulating substrate 40. A third connection member 42 having a flange portion 42*a* protruding outward in a radial direction is formed integrally with the other end of the cylinder portion 41.

Further, the tub-like arc extinguishing chamber 1, in which the lower surface is open, is formed of the fixed terminal support insulating substrate 40 and the cylinder portion 41 brazed thereto, and the arc extinguishing chamber connection portion 6 is configured of the arc extinguishing chamber 1 and the flange portion 42*a* of the third connection member 42.

Regarding the brazing of the fixed terminal support insulating substrate 40 and the fixed terminals 2 and pipe 3, and the brazing of the outer peripheral edge portion 40*c* of the fixed terminal support insulating substrate 40 and the cylinder portion 41, it is preferable that the brazing processes are carried out simultaneously using, for example, a furnace brazing process.

Also, a ceramic insulating tubular body 43 is disposed on the inner peripheral surface of the cylinder portion 41, and is closed off by an insulating bottom plate 44 on the base plate 7 side of the insulating tubular body 43.

Meanwhile, a bottomed tubular cap 45 is disposed on the lower surface side of the aperture hole 7*a* of the base plate 7. A second connection member 46 is integrally formed on an open end portion of the cap 45. The second connection member 46 is configured of a tube portion 46*a* and a flange portion 46*b* protruding outward in a radial direction from an open end of the tube portion 46*a*.

Further, the flange portion 42*a* of the third connection member 42 and the flange portion 46*b* of the second connection member 46 close contact the base plate 7 and are seal welded so that the arc extinguishing chamber connection portion 6 and cap connection portion 12 are in communication via the aperture hole 7*a* of the base plate 7.

In the second embodiment too, it is preferable that the second and third connection members 46 and 42 are formed using a material with a low expansion rate, the base plate 7 is formed using a magnetic material, and the cap 45 is formed using a non-magnetic material.

In actual practice, when assembling the capsule structure portion 13, the movable terminal 27, in which the movable contact 27*a* is disposed, disposed inside the arc extinguishing chamber 1, the movable shaft 28 that supports the movable terminal 27, and the contact spring 29, disposed around the movable shaft 28, that presses the movable contact 27*a* against the fixed contact 26 are disposed on one surface of the base plate 7, while the movable iron core 30 and return spring 31 linked to the movable shaft 28, which is extended penetrating the aperture hole 7*a*, are disposed on the other surface, as illustrated in FIG. 4. Further, the arc extinguishing chamber connection portion 6 is disposed on the base plate 7 so as to cover the movable terminal 27, movable shaft 28, and contact spring 29, and the cap connection portion 12 is disposed on the base plate 7 so as to cover the movable shaft 28, movable iron core 30, and return spring 31, and the arc extinguishing chamber connection portion 6 and cap connection portion 12 are seal welded to the base plate 7.

In the second embodiment too, the brazing of the fixed terminals 2, pipe 3, and third connection member 42 to the fixed terminal support insulating substrate 40 can be carried out simultaneously, and the connection of the fixed terminals 2 and pipe to the arc extinguishing chamber 1 and the formation of the arc extinguishing chamber connection portion 6 can be carried out simultaneously, and it is thus possible to simplify the step of forming the arc extinguishing chamber 1 and arc extinguishing chamber connection portion 6.

Moreover, as the fixed terminal support insulating substrate 40 is such that a metalizing process is implemented on a plate-like ceramic base, it is possible to carry out simultaneous metalizing processes in a condition wherein a plurality of ceramic bases are disposed, and it is thus possible to improve the production rate. Also, as it is sufficient that a brazing jig when brazing the fixed terminal support insulating substrate 40 and cylinder portion 41 has a simple structure, it is possible to configure an assembly jig at a low cost.

Also, it is possible to apply the same gas encapsulating method as in the first embodiment to the encapsulating of gas in the arc extinguishing chamber 1 and cap 45.

In the second embodiment, a description has been given of a case wherein the cap 45 and second connection member 46 are formed integrally but, not being limited to this, the cap 45 and second connection member 46 may be configured of separate bodies, in the same way as in the first embodiment.

Industrial Applicability

According to the invention, it is possible to simplify a gas encapsulating step of a capsule structure portion configured of an arc extinguishing chamber connection portion and cap connection portion, thereby providing an electromagnetic contactor, electromagnetic contactor gas encapsulating method, and electromagnetic contactor manufacturing method at a low cost and with stable quality.

REFERENCE SIGNS LIST

1 Arc extinguishing chamber
1*a* Arc extinguishing chamber aperture end portion
2 Fixed terminal
2*a* Stepped vent
3 Pipe
3*a* Pipe aperture portion
4 First connection member
4*a* Tube portion
4*b* Flange portion
5 Second connection member
5*a* Tube portion
5*b* Flange portion

6 Arc extinguishing chamber connection portion
7 Base plate
8 Cap
12 Cap connection portion
13 Electromagnetic contactor capsule structure portion
40 Fixed terminal support insulating substrate
41 Cylinder portion
42 Third connection member
42*a* Flange portion
43 Insulating tubular body
44 Insulating bottom plate
45 Cap
46 Second connection member

What is claimed is:

1. An electromagnetic contactor, comprising:

a base plate having an aperture hole;

a tub-shaped arc extinguishing chamber in which one end thereof is open, including a fixed terminal penetrating and fixed to a wall surface, the fixed terminal having a vent portion obliquely extending therethrough, and a pipe obliquely inserted from outside the wall surface and connecting the vent portion to form a portion communicating between a portion outside the wall surface of the fixed terminal and a portion inside the wall surface of the fixed terminal; and a bottomed tubular cap in which one end thereof is open, wherein an arc extinguishing chamber connection portion is formed by the arc extinguishing chamber and a first connection member having a tube portion in which one end thereof close contacts with and is connected to an open end surface of the arc extinguishing chamber and a flange portion linked to the other end of the tube portion and closely contacting with the base plate, a cap connection portion is formed by the cap and a second connection member having a tube portion in which one end thereof close contacts with and is connected to an open end surface of the cap and a flange portion linked to the other end of the tube portion and closely contacting the base plate, and the flange portion of the first connection member of the arc extinguishing chamber connection portion is attached to one surface of the base plate, and the flange portion of the second connection member of the cap connection portion is attached to the other surface of the base plate, so that the arc extinguishing chamber connection portion and the cap connection portion are in communication through the aperture hole of the base plate.

2. A electromagnetic contactor according to claim 1, wherein gas is introduced through the pipe into the arc extinguishing chamber and the cap, and when a pressure of the introduced gas reaches a predetermined pressure, an aperture portion of the pipe is closed off, which creates a state wherein the gas is sealed.

3. A gas encapsulating method of the electromagnetic contactor according to claim 1, wherein gas is introduced from the pipe, and when a pressure of the introduced gas reaches a predetermined gas pressure, an aperture portion of the pipe is closed off to form a gas encapsulating sealed vessel wherein the gas is sealed in the arc extinguishing chamber and the cap.

* * * * *

UNITED STATES PATENT AND TRADEMARK OFFICE

CERTIFICATE OF CORRECTION

PATENT NO. : 8,803,642 B2
APPLICATION NO. : 14/134656
DATED : August 12, 2014
INVENTOR(S) : Seiji Imamura et al.

It is certified that error appears in the above-identified patent and that said Letters Patent is hereby corrected as shown below:

In the Specification

Change column 1, line 37, from "... and The arc extinguishing..." to -- and the arc extinguishing --.

Change column 2, line 4, from "... one portion of the workpiece 2..." to -- one portion of the workpiece 24 --.

Change column 7, line 48, from "... the base plate V..." to -- the base plate 7 --.

Signed and Sealed this
Twenty-fourth Day of February, 2015

Michelle K. Lee

Michelle K. Lee
*Deputy Director of the United States Patent and Trademark Office*